United States Patent [19]

Watson

[11] 4,014,552

[45] Mar. 29, 1977

[54] TETHERED GOLF BALL METER

[76] Inventor: Thomas Arthur Watts Knott Watson, Box 546 Mount Royal Post Office, Montreal P.Q., Canada, H3P 3C7

[22] Filed: Oct. 20, 1975

[21] Appl. No.: 624,271

[52] U.S. Cl. ..... 273/185 C; 273/200 R

[51] Int. Cl.[2] ..... A63B 69/36

[58] Field of Search ..... 273/185 C, 184 B, 200 R, 273/185 R, 185 A, 185 B, 185 D, 184 R; 35/29 A

[56] References Cited

UNITED STATES PATENTS

| | | | |
|---|---|---|---|
| 1,240,198 | 9/1917 | Guthrie et al. | 273/185 C |
| 1,828,091 | 10/1931 | Spafford | 273/185 C |
| 1,857,267 | 5/1932 | Tyler et al. | 273/185 C |
| 3,031,889 | 5/1962 | Magazanik et al. | 273/185 C |
| 3,430,493 | 3/1969 | Wall | 273/185 C X |
| 3,494,621 | 2/1970 | Windall | 273/185 C X |

*Primary Examiner*—George J. Marlo

[57] ABSTRACT

A tethered golf ball is attached to a meter which registers the distance and direction of the expected travel of the golf ball. The distance of travel is measured as a function of the pull on an elastic. The direction of travel is registered by the position of a horizontal arm pivoted about a vertical axis. The tether is slidably attached to this arm. A locking arrangement is provided to prevent ball rebound from changing the angular reading on the meter.

1 Claim, 3 Drawing Figures

TETHERED GOLF BALL METER

The invention relates to a tethered golf ball meter and more specifically to an arrangement for measuring the angular direction of travel of a tethered golf ball. Golf ball distance measuring devices are well known, however, those which measure the angular direction of travel are either complex or give irratic readings due to rebound.

An object of the invention is to provide a simple means of measuring the direction of travel of a tethered golf ball.

Another objective of the invention is to provide a locking arrangement to prevent rebound from causing irratic angular readings.

Figure 1:
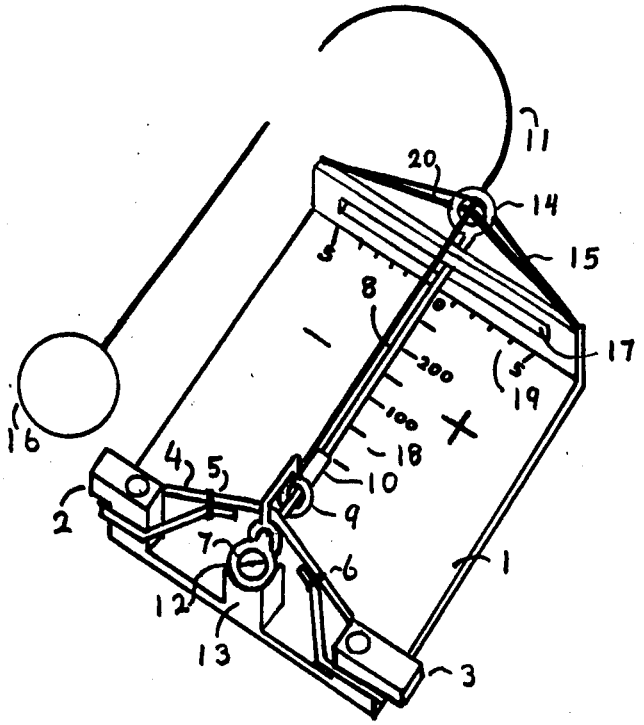
FIG. 1 is a pictorial view of the golf meter.
Figure 2:
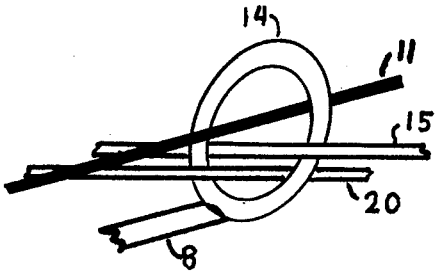
FIG. 2 is a detailed view of the golf meter of FIG. 1 locking arrangement.

FIG. 1 shows a base 1 having posts 2, 3, and 13, a slot 17, a distance scale 18 and an angular scale 19. A rod 8 is pivotly mounted to post 13 by means of its eyelet 12 and screw 7. A slider 9 and an indicator 10 are slidably mounted to rod 8. Rod 8 passes through slot 17. A cord 11 is tied to slider 9 and passes through eyelet 14 at the movable end of rod 8. A golf ball 16 is attached to cord 11. Elastics 15 and 20 are attached to both sides of base 1 and passes through eyelet 14. Elastics 15 and 20 pass through eyelet 14 in different directions. An elastic 4 is looped around posts 2 and 3, and its ends are secured by clips 5 and 6. Elastic 4 is placed between slider 9 and rod 8. Rod 8 pivots about screw 7 and slides horizontally in slot 17.

Figure 3:
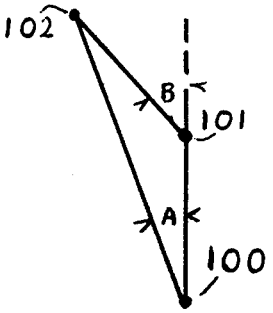
FIG. 3 is a diagram of the path of the ball.

Initially rod 8 is positioned in the center of the slot 17 at the 0 angle position and indicator 10 is positioned at the bottom of the distance scale. Ball 16 is then pulled to the end of its tether and is positioned in line with rod 8 and is hit over the measuring device. The player positions himself in front of the measuring device near the ball 16. Posts 2 and 3 are defined as being on its front. When ball 16 is hit, cord 11 pulls on slider 9 which in turn pulls on elastic 4. Indicator 10 is then pushed up rod 8 by slider 9. The deflection of elastic 4 is momentary and slider 9 returns back to its initial position. Indicator 10 remains positioned on rod 8 at the extremity of its travel. The probable distance of travel is then read off the distance scale 18. If the ball 16 deviates from its intended path of travel arm 8 will be angularily displaced about screw 7 and will move horizontally in slot 17, due to the horizontal pull of cord 11 on eyelet 14. The angular deviation of the flight of the ball is read off of scale 19 by using rod 8 as a pointer or indicator. Elastics 15 and 20 serve to steady the motion of rod 8 and prevents it from erractically sliding in slot 17. Slot 17 limits the horizontal travel of rod 8 and prevents it from moving vertically. The angular movement of rod 8 is twice that of the ball's path, as shown in FIG. 3. The scale can be made to compensate for this factor of two difference. FIG. 3 shows point 100 as the position from which the ball was hit, 101 is the measuring device and 102 is the position of the ball when it hits the ground. A is the angle of travel of the ball and B is the measured angle.

When ball 16 is hit over base 1 the cord or tether 11 pulls against elastic 4 and upwards on eyelet 14. It may also pull sideways against eyelet 14. When the ball 16 reaches the end of its travel it hits the ground and it rebounds back toward the player. This rebound may cause another sideways pull agsinst eyelet 14, resulting in changing the angular reading To prevent this occurance cord 11 slips over eyelet 14 on the rebound and pulls against elastic 15 or 20. This effectively locks eyelet 14 to either elastic 15 or 20 during the rebound thus preventing a change of reading. To insure that the cord 11 slips over eyelet 14, eyelet 14 is inclined at an angle to the horizontal, such that when the ball rebounds toward the player cord 11 slips downward along the side of the eyelet, hence making positive contact with either elastic 15 or 20.

I claim:

1. A tethered golf ball distance and angular measuring device comprising, a tether having one end attached to a golf ball, a horizontal rod pivoted at one end about a verticle axis, said rod having an eyelet at its other end remote from the pivoting point, said tether threaded through the eyelet, said tether's other end attached to a distance measuring means, means for indicating the angular position of the rod, a first elastic cord and a second elastic cord threaded through the eyelet, and the elastic cords mounted in a substantially horizontal plane perpendicular to the rod, the elastic cords threaded through the eyelet in a manner such that they cross over inside the eyelet, wherein the axis which is perpendicular to the eyelet and runs through the center of the eyelet is inclined away from the horizontal and passes through an imaginary upward extension of the rod's pivoting axis.

* * * * *